US007832719B2

(12) United States Patent
Van Den Berg

(10) Patent No.: US 7,832,719 B2
(45) Date of Patent: Nov. 16, 2010

(54) METHOD AND BUFFER STATION FOR BUFFERING DOCUMENTS

(75) Inventor: René Van Den Berg, Groningen (NL)

(73) Assignee: Neopost Technologies SA, Bagneux (FR)

( * ) Notice: Subject to any disclaimer, the term of this patent is extended or adjusted under 35 U.S.C. 154(b) by 0 days.

(21) Appl. No.: 11/767,668

(22) Filed: Jun. 25, 2007

(65) Prior Publication Data

US 2008/0006988 A1 Jan. 10, 2008

(30) Foreign Application Priority Data

Jun. 23, 2006 (NL) ..... 1032054

(51) Int. Cl.
*B65H 5/22* (2006.01)
*B65H 83/00* (2006.01)
*B65H 85/00* (2006.01)

(52) U.S. Cl. ..... 271/3.03; 271/3.01; 271/3.14

(58) Field of Classification Search ..... 271/3.01, 271/3.03, 3.14
See application file for complete search history.

(56) References Cited

U.S. PATENT DOCUMENTS 3,683,758 A * 8/1972 Feldkamper ..... 414/788.4
3,724,840 A * 4/1973 Kuckhermann ..... 271/182
4,355,880 A * 10/1982 Stemmle ..... 399/373
4,824,090 A * 4/1989 Booth, Sr. et al. ..... 271/3.03
4,855,788 A * 8/1989 Fujii ..... 399/367
4,861,014 A * 8/1989 Martin ..... 271/198
4,953,843 A * 9/1990 Reist ..... 271/3.01
5,899,453 A 5/1999 Middelberg et al.
6,124,561 A * 9/2000 Luckhurst et al. ..... 209/583
6,244,584 B1 * 6/2001 Holbrook et al. ..... 271/3.07
6,338,479 B1 * 1/2002 Van Der Werff et al. ... 271/3.01
7,055,816 B2 * 6/2006 Leu ..... 271/3.01
2003/0083778 A1 * 5/2003 Masotta ..... 700/219
2004/0172158 A1 * 9/2004 Hart, Jr. et al. ..... 700/223
2005/0035521 A1 * 2/2005 Stauber et al. ..... 270/58.23

FOREIGN PATENT DOCUMENTS

EP 0927693 A1 * 7/1999

(Continued)

OTHER PUBLICATIONS

Patent Abstract of Japan, Publication No. 61081354, Publication Date Apr. 24, 1986, Corrugated Sheet Transfer Conveyer.

*Primary Examiner*—Patrick Mackey
*Assistant Examiner*—Prasad V Gokhale
(74) *Attorney, Agent, or Firm*—Sughrue Mion, PLLC

(57) ABSTRACT

Between a document feeding device and a document processing device, documents are received in a sequential order in a buffer station, temporarily stored in a transport path and delivered in the order of receipt. The transport of the documents in a collecting portion of the transport path is controlled separately from the transport of the documents in a delivery portion of the transport path. After delivery of a single or last document present in the delivery portion from the delivery portion, and before the piece-by-piece delivery of documents of a next group from the delivery portion is started, the next group of documents collected in the collecting portion is passed on to the delivery portion. A buffer station for practicing the method is also described.

4 Claims, 2 Drawing Sheets

FOREIGN PATENT DOCUMENTS

| | | | | |
|---|---|---|---|---|
| EP | 1288153 | A2 | | 5/2003 |
| EP | 1493700 | A2 | | 1/2005 |
| FR | 0927693 | A1 | * | 7/1999 |
| JP | 61081354 | A | * | 4/1986 |
| WO | 9714639 | | | 4/1997 |

* cited by examiner

METHOD AND BUFFER STATION FOR BUFFERING DOCUMENTS

FIELD AND BACKGROUND

This disclosed embodiments relate to a method and a buffer station for buffering documents.

To allow a printer to print at maximum speed, it is of importance that the printer has instructions for printing at least a minimum amount of sheets in its memory. In practice, depending on the type of printer and the nature and dimensions of the printing, this number is typically between 5 and 10 sheets. If a printer is used as document feeding device in combination with a document processing device downstream of the printer, the problem occurs that if a malfunction occurs, as a result of which the document processing device needs to be stopped and, in response, also the transmission of instructions for printing pages to the printer is stopped, the printer will still print and feed the pages for which the printing instructions had already been received but not processed yet. In practice, this number mostly involves a few to about ten sheets.

Such a method and such a buffer station are known from European patent specification 0 927 693. They provide a buffer capacity, in which the sheets still coming out of the printer after the document processing device has stopped and, in response, the transmission of instructions for printing pages to the printer has stopped, can be temporarily stored and from which the sheets after re-actuation of the document processing device can again be delivered piece by piece. An advantage of this solution is that it is not necessary to stop the printer via hardware or software. Such solutions are relatively difficult to realize, in particular if it is desired to enable a document processing device to cooperate with a large variety of printers.

A drawback of the above-described known solution is that it is difficult and possible only to a rather limited extent to deliver further documents to the document processing device during buffering.

SUMMARY

It would be advantageous to provide a solution which, where buffering is concerned that, allows a greater flexibility and in particular offers a greater freedom as regards the piece-by-piece delivery of documents to the document processing device during collection of documents coming from the document feeding device in a buffer stock.

In one aspect, the disclosed embodiment provide a method for buffering documents between a document feeding device and a document processing device, wherein:

the documents are received in a sequential order;

the documents are transported in the sequential order via a transport path, wherein at least a number of the documents are temporarily stored in the transport path in a configuration in which the documents are in positions with a mutual pitch in transport direction; and the received documents are delivered separately from each other in the same sequential order from the transport path.

In this method, the transport of the documents in a collecting portion of the transport path is controlled separately from the transport of the documents in a delivery portion of the transport path downstream of the collecting portion. Further, in response to the delivery of a single or last document present in the delivery portion from the delivery portion, a group of documents collected in the collecting portion is passed on to the delivery portion before the piece-by-piece delivery of documents of the group collected therein from the delivery portion is started.

The disclosed embodiments can also be embodied in a buffer station for buffering documents between a document feeding device and a document processing device, equipped with:

a transport path with an upstream end for receiving the documents in a sequential order, for transporting and temporarily storing documents in positions with a mutual pitch in transport direction and for, in the sequential order of receipt, transporting and piece-by-piece delivering the documents from the transport path;

a control unit arranged and actively coupled with the transport path, for controlling the transport path for receiving, selectively transporting and temporarily storing as well as delivering documents;

wherein the transport path includes a collecting portion and a delivery portion downstream of the collecting portion, wherein transport drive parts of the collecting portion and of the delivery portion are controllable separately from each other, and wherein the control unit is coupled with the transport drive parts and is arranged for controlling the transport drive parts for, in response to the delivery of a single or last document from the delivery portion, transporting all documents collected in the collecting portion to the delivery portion.

More specific design options of the disclosed embodiments are set forth in the dependent claims. Further aspects, details and effects of the disclosed embodiments are described below on the basis of exemplary embodiments.

DETAILED DESCRIPTION

Figure 1:
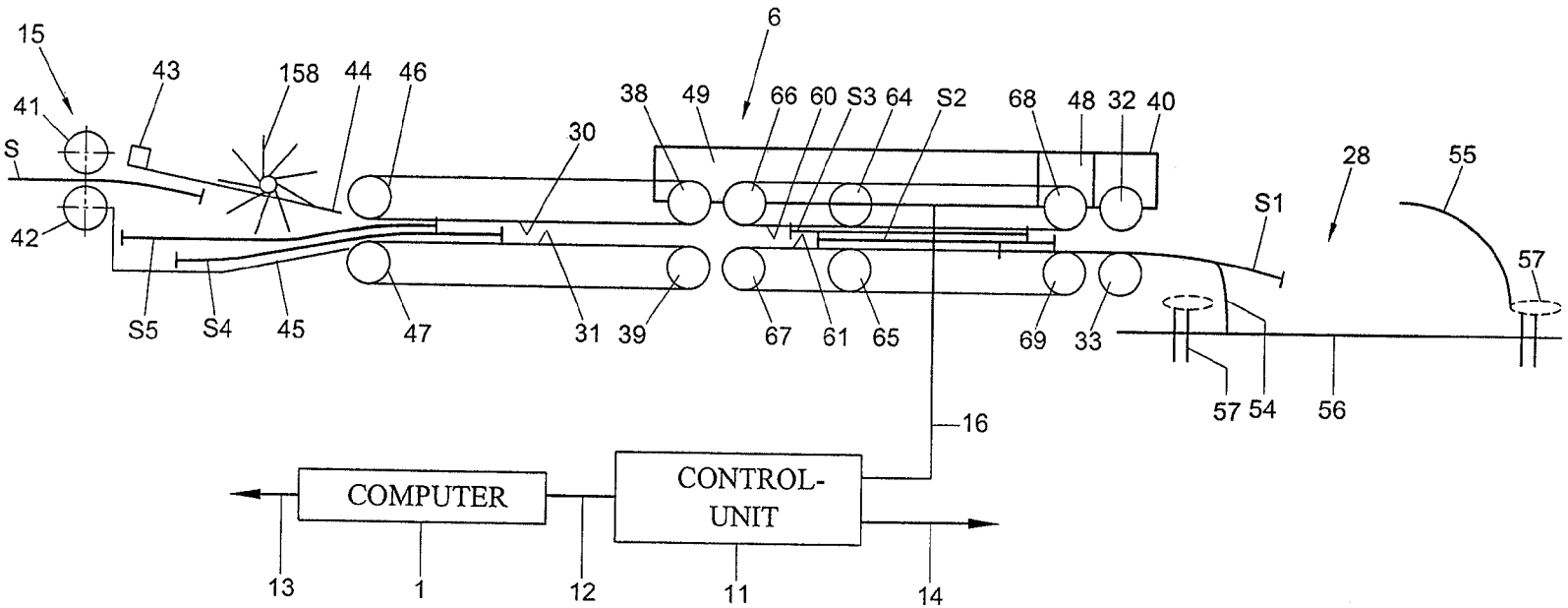
FIG. 1 is a schematic representation in side elevation of an exemplary buffer station according to the disclosed embodiments.

The disclosed embodiments will primarily be further elucidated with reference to the exemplary embodiment illustrated in FIG. 1. The disclosed embodiments can be used with particular advantage as a first station after a printer, upstream of or as part of a finishing system such as an inserter system which may further be equipped, for instance, with one or more insert feeder stations, a folding station and an inserter station.

However, also other finishing systems, such as binding systems or packaging systems, may be arranged downstream of the buffer apparatus. Further, depending on the desired production method, it is also possible, instead of a printer, to use a different document feeding device, such as a reading device, a copying device, or a plasticizing device, that stops with some delay after an instruction to stop or to discontinue instructions to feed next documents.

For controlling the buffer apparatus, there is provided a control unit 11 which communicates via a connection 12 with a computer 1, communicates via a connection 14 with a control unit of an inserter (not represented), and communicates via a connection 16 with a drive structure with transport drive parts 40, 48, 49 of the buffer apparatus 6. Alternatively, the control unit can also be part of an inserter. The computer 1 is coupled via a connection 13 with a control unit of a printer (not represented).

The buffer apparatus 6 has an inlet 15 for receiving sheets from the printer or sets of sheets from a collecting station. Where in this context reference is made to a sheet, sheets, a document, or documents, these terms can also be understood to mean a set of sheets, sets of sheets, a set of documents or sets of documents, respectively.

In order to produce the desired documents, the data regarding the printing to be provided is converted into printing instructions in accordance with the requirements valid for the printer in question. These printing instructions are then transmitted to the printer, where they are stored in a memory and where documents are printed in accordance with the printing instructions consecutively read from that memory.

The control unit 11 is arranged for controlling the transport drive parts 40, 48, 49 of the buffer apparatus 6, such that in normal operation, sheets received piece by piece are passed on and delivered at a downstream end 28 of a transport path 29.

The transport path 29 of the buffer apparatus 6 is formed by two pairs of transport belts 30, 31 and 60, 61. For the sake of clarity, in FIG. 1 a gap is present between the belts 30, 31, 60, 61, and between rollers 32, 33 downstream of the belts 60, 61 on opposite sides of the transport path 29, but in practice opposite surfaces preferably form a transport nip which is closed when no sheets or the like are disposed therebetween. These transport nips are located between transport rollers 32, 33, between the transport belts 30, 31, and between the transport belts 60, 61, and are spaced apart in transport direction. The transport belts 30, 31 pass over rollers 38, 39, 46, 47 and the transport belts 60, 61 pass over transport rollers 66-69. Of these rollers, the rollers 38, 68 are connected with the transport drive parts 48, 49 for rotating those rollers 38, 68 and thereby driving the transport belts 30, 31, 60, 61. Also the upper roller 32 of the roller pair 32, 33 is connected with one of the transport drive parts 40. The drive structure 40, 48, 49 according to this example is thus arranged for driving the transport belts 30, 31, 60, 61 and the transport rollers 32, 33 in transport direction. The drive structure is equipped with a motor, and separately controllable clutches for separately coupling the rollers 32, 38, 68 to the motor are included in the respective transport drive parts 40, 48, 49. Alternatively, it is also possible to provide the transport drive parts 40, 48, 49 with separately controllable motors for separately controlling the drive of the rotation of the rollers 32, 38, 68 or to that end to provide a combination of motors and clutches.

The inlet 15 of the buffer apparatus 6 is formed by a pair of feed-in rollers 41, 42. Further, just downstream of the feed-in rollers 41, 42, there is a sensor 43 for detecting the arrival of documents. Further, located between the feed-in rollers 41, 42 and the transport belts 30, 31 are upper and lower paper guides 44, 45 and a rotatable brush 158 for pressing down and passing-on received sheets.

Located downstream of the buffer apparatus 6 are paper guides 54, 55, which are located above a transport surface 56. Extending through slots (not visible in the drawing) in the transport surface 56 are transport fingers 57 which are movable in transport direction for transporting sheets over the transport surface 56.

In operation, sheets fed piece by piece by the printer are first received between the continuously driven feed-in rollers 41, 42 and detected as soon as the leading edge has reached a position adjacent the sensor 43. As long as the inserter system works with a shorter stroke time than does the printer, the sheets are always transported directly through the buffer station to a delivery position between the rollers 32, 33 and delivered, for instance after a 'ready' signal has been received from the inserter system via the connection 14. Thus, at least a first specimen of the sheets is transported over at least some distance in the system. The pitch between successive specimens of the sheets in the transport path 29, under normal circumstances, is always greater than or equal to the dimensions of the sheets in question in transport direction, so that the sheets do not overlap.

As soon as a malfunction occurs in the inserter system, or if the printer feeds successive sheets one after the other faster than the inserter system can take them in, the stroke time of the printer is, at least temporarily, shorter than that of the inserter system. In particular when using a printer in line with a downstream finishing system, sometimes the situation arises where, if in response to a disturbance the transport of a sheet in the downstream system is stopped, the printer only stops feeding sheets after some delay. In response to such a temporarily longer stroke time of the downstream sheet-processing system than of the upstream, sheet-feeding system, the control unit 11 controls the drive structure 40 of the buffer apparatus 6 for temporarily buffering following sheets.

The temporary collection of the sheets according to this example is done in a configuration with a pitch in transport direction which is less than the length in transport direction of the sheets in question. In FIG. 1, the apparatus is represented in an operating condition in which between the upstream belts 30, 31 two sheets $S_4$, $S_5$ have been collected in a configuration of mutual overlap in transport direction. Disposed between the downstream pair of belts 60, 61 are three sheets $S_1$, $S_2$, $S_3$.

When the inserter system is in operation again, sheets from sets which have been passed on to the downstream pair of belts 60, 61 are delivered piece by piece to the transport surface 56. This is illustrated in FIG. 1 by driving the delivery of the sheet $S_1$ by the rollers 32, 33 while the sheets $S_2$, $S_3$ are still retained between the belts 60, 61. To this end, according to this example, suitably positioned press-on rollers 64, 65 are provided. The collected sheets are thus moved from the configuration in which they have been collected, in the order in which they have been collected, away from each other and, with mutual interspaces, transported further over the transport surface 56. When the sheet S1 is clear of the transport rollers 32, 33, the next sheet $S_2$ is brought in the delivery position between the transport rollers 32, 33.

Storing sheets or sets of sheets which are to be temporarily kept in a buffer stock, in a configuration staggered in transport direction but with a shortened pitch in transport direction, offers the advantage that on the one hand the buffer stock occupies little space in transport direction and that, on the other hand, the collected sheets or sets of sheets, on the basis of their positions in transport direction, can easily be moved away from each other again when they are to be processed further. In particular, no separation system is needed, as is the case for separating sheets stored in a stack. The sheets can be readily moved away from each other again, in that it is simple to arrange for the downstream nip between the rollers 32, 33 to engage exclusively a sheet or set of sheets to be delivered.

Meanwhile, between the upstream transport belts 30, 31, the sheets $S_4$, $S_5$ are brought into a configuration where they overlap like roof-tiles, by moving the transport belts 30, 31, each time when a sheet reaches those belts, only over a distance that is less than the length in transport direction of each of the sheets. All this can be realized with a simple transport structure, and the overlapping storage makes it possible to store a very great number of sheets without necessitating complex facilities for retaining the separate sheets or sets of sheets.

The detector 43 for detecting received documents in the area of the inlet 15 is connected with the control unit 11, which is arranged for operating the drive structure 40, such that during collection in response to detection of a received sheet, the upstream pair of belts 30, 31 are moved over a particular distance in transport direction. This distance determines the mutual pitch between sheets or sets of sheets that are stored between the transport belts 30, 31.

The group of sheets $S_1$-$S_3$ may for instance have been collected in response to a temporary disturbance in the sheet-processing system downstream of the buffer system 6. In response to the delivery of the last sheet $S_3$ of the group $S_1$-$S_3$ from the delivery portion of the transport path 29, which delivery portion according to this example extends between rollers 32, 33 and between the belts 60, 61, the group of sheets $S_4$, $S_5$ collected in the collecting portion (and any further sheets meanwhile added to them) is passed on to the portion of the transport path 29 between the belts 60, 61 before the piece-by-piece delivery of sheets $S_4$, $S_5$ of this group from the delivery portion is started. As the transport of the sheets in the collecting portion of the transport path 29, in this example between the upstream belts 30, 31, is controlled separately from the transport of the sheets in the delivery portion of the transport path 29, according to this example between the downstream belts 60, 61, it is possible to collect sheets into a group of mutually overlapping sheets while sheets from a previously collected group are being delivered piece by piece.

After the buffering of the group of sheets $S_1$-$S_3$ there was no need to defer receiving the next sheets $S_4$, $S_5$ until all sheets of the buffered group $S_1$-$S_3$ would have been delivered. The sheet feeding device can start or resume the feeding of sheets after passing on the buffered group from the collecting portion to the delivery portion and prior to the piece-by-piece delivery of a last sheet of the buffered group of sheets from the delivery portion.

In order to stop or delay the printing of sheets only when such is unavoidable, preferably a run-out value is stored which indicates how many sheets the printer will still feed when the transmission of printing instructions to the printer is discontinued. Then the printer, after the start of the collection of sheets in the collecting portion, according to this example between the transport belts 30, 31, is controlled with a delay for stopping or delaying the feeding of sheets. This delay of control is then preferably chosen such that during the collection of sheets in the collecting portion the instruction to interrupt the feeding of sheets or to discontinue the transmission of printing instructions is generated in response to the reaching of a residual capacity in the collecting portion that is equal to the stored run-out value plus a possible predetermined additional margin. The additional margin can serve for instance as a safety margin and/or to compensate any delays in detection and signal processing.

In many cases, it is necessary, after the piece-by-piece delivery of sheets from a buffered group of sheets, to buffer a group of sheets several more times before it is possible to proceed to passing on sheets without buffering. Then, preferably, of a number of successively collected groups of sheets, in each case each next group of sheets that is collected in the collecting portion during the feeding of documents from the document feeding device is smaller than the preceding group of documents collected in the collecting portion.

Figure 2:
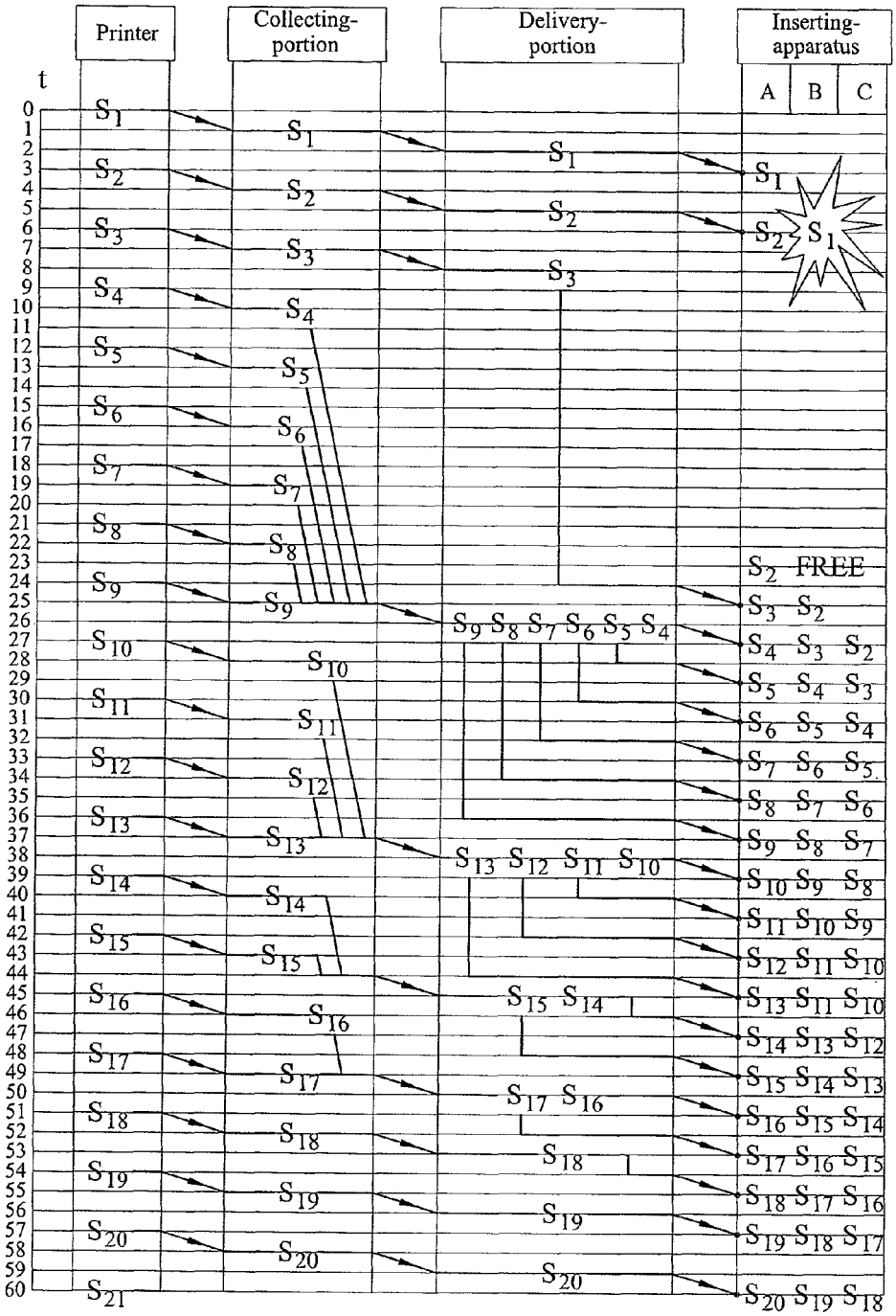
FIG. 2 is a diagram representing an illustrative example of the operation of an example of an apparatus according to the disclosed embodiments in case of a malfunction.

This is illustrated by the diagram represented in FIG. 2, which vertically plots time in stroke units and horizontally plots the progress of documents $S_n$ from the printer via the collecting portion and the delivery portion to stations A, B and C of an inserter.

According to this example, at t=6, the sheet $S_1$ jams in station B. At that moment, the sheet $S_3$ is in the delivery portion and is retained there. Next sheets $S_4$-$S_9$ are collected in the collecting portion while the malfunction is being resolved, for instance by an operator. In this example, this is successfully done quickly and at t=23 the inserter system is cleared again for receiving documents. Thereupon, in stroke 24 to 25, the sheet $S_3$ is individually delivered to the inserter system and in stroke 25 to 26 the collected sheets $S_4$-$S_9$ are moved as a group from the collecting portion to the delivery portion.

Next, from t=26 to t=37, the sheets $S_4$-$S_9$ are delivered piece by piece from the delivery portion while a new group of sheets $S_{10}$-$S_{13}$ is being collected in the collecting portion. The capacity of the collecting portion in this example was sufficient to take up the feed by the printer until the delivery of sheets was resumed, without it being necessary to interrupt the transmission of printing instructions to the printer.

After the delivery portion is free because the last document $S_9$ of the previous group has been delivered, the meanwhile collected group $S_{10}$-$S_{13}$ is moved as a group from the collecting portion to the delivery portion. This second group $S_{10}$-$S_{13}$ of sheets is smaller than the previous group $S_4$-$S_9$, because the buffer system can deliver more documents to the inserter system per unit time than the printer feeds to the buffer system per unit time. While thereupon also the sheets of this group $S_{10}$-$S_{13}$ are delivered piece by piece, a next group of sheets $S_{14}$-$S_{15}$ is collected in the collecting portion. In turn, this group is passed on as a group to the delivery portion. The lag has not been wholly made up yet by then, and one more time a group of sheets $S_{16}$, $S_{17}$ is collected, passed on and delivered piece by piece. From t=54, the buffer system is in normal operation again and sheets $S_{19}$ and so on are delivered with a constant transit time through the buffer system.

The invention claimed is:

1. A method, for buffering documents between a document feeding device and a document processing device, comprising:

receiving the documents in a sequential order;

transporting the documents in said sequential order via a transport path, comprising, in response to a malfunction of the document processing device or a stroke time for a printer which is at least temporarily shorter than a stroke time of the processing device, collecting in a collecting portion of the transport path at least a number of the documents as a group in which the documents are in mutually overlapping positions with a mutual pitch in transport direction, while a previously collected group of the documents in which the documents are in mutually overlapping positions with a mutual pitch in transport direction is present in a delivery portion of the transport path downstream of the collecting portion, wherein the collected and mutually overlapping documents in the collecting portion are displaced along the collecting portion of the transport path relative to the previously collected group of documents in the delivery portion of the transport path; and delivering the documents of said previously collected group separately from each other in said sequential order from the delivery portion of the transport path and displacing the remaining documents of the previously collected group of documents in the delivery portion of the transport path relative to the collected and mutually overlapping documents in the collecting portion;

wherein in response to the delivery of a last document present in the delivery portion from the delivery portion, the entire group of documents collected in the collecting portion is passed on to the delivery portion before the piece-by-piece delivery of documents of said group from the delivery portion is started and wherein the document feeding device feeds additional documents after the passing-on of said group of documents from the collecting portion to the delivery portion and prior to the piece-by-piece delivery of a last document of said group from the delivery portion, and wherein during the piece-by-piece delivery of documents of said group from the delivery portion, the additional documents fed by the feeding device are collected in the collecting portion.

2. A method for buffering documents between a document feeding device and a document processing device, comprising:

receiving the documents in a sequential order;

transporting the documents in said sequential order via a transport path, comprising temporarily storing in the transport path at least a number of the documents in a configuration in which the documents are in positions with a mutual pitch in transport direction; and delivering the received documents separately from each other in said sequential order from the transport path, wherein the transport of the documents in a collecting portion of the transport path is controlled separately from the transport of the documents in a delivery portion of the transport path downstream of the collecting portion;

wherein in response to the delivery of a single or last document present in the delivery portion from the delivery portion, a group of documents collected in the collecting portion is passed on to the delivery portion before the piece-by-piece delivery of documents of said group from the delivery portion is started, and wherein in a memory a run-out value is stored which indicates a maximum number of documents which the document feeding device still feeds after interruption of instructions to feed documents and wherein during the collection of documents in the collecting portion the instruction to the document feeding device to interrupt the feeding of documents is generated or the transmission of feeding instructions to the document feeding device is interrupted in response to the reaching of a residual capacity in the collecting portion which is equal to said run-out value plus a possible predetermined additional margin.

3. A method for buffering documents between a document feeding device and a document processing device, comprising:

receiving the documents in a sequential order;

transporting the documents in said sequential order via a transport path, comprising temporarily storing in the transport path at least a number of the documents in a configuration in which the documents are in positions with a mutual pitch in transport direction; and delivering the received documents separately from each other in said sequential order from the transport path, wherein the transport of the documents in a collecting portion of the transport path is controlled separately from the transport of the documents in a delivery portion of the transport path downstream of the collecting portion;

wherein in response to the delivery of a single or last document present in the delivery portion from the delivery portion, a group of documents collected in the collecting portion is passed on to the delivery portion before the piece-by-piece delivery of documents of said group from the delivery portion is started, wherein after the passing-on of a group of documents from the collecting portion and during the feeding of documents from the document feeding device, at least a next group of documents is collected in the collecting portion, wherein each next group of documents that is collected in the collecting portion during the feeding of documents from the document feeding device, in each case is smaller than the preceding group of documents collected in the collecting portion, until a given minimal transit time through the collecting portion has been achieved.

4. A buffer station for buffering documents between a document feeding device and a document processing device, comprising:

a transport path with an upstream end for receiving the documents in a sequential order, for transporting and temporarily storing documents in mutually overlapping positions with a mutual pitch in transport direction and for, in the sequential order of receipt, transporting and piece-by-piece delivering documents from the transport path, the transport path comprising a collecting portion and a delivery portion downstream of the collecting portion, wherein transport drive parts of the collecting portion and of the delivery portion are controllable separately from each other; and a control unit arranged and actively coupled with the transport path, for controlling the transport path for:

receiving, selectively transporting and, in response to a malfunction of the document processing device or a stroke time of a printer which is at least temporarily shorter than a stroke time of the processing device, collecting, in the collecting portion of the transport path, at least a number of the documents as a group in which the documents are in mutually overlapping positions with a mutual pitch in transport direction, while a previously collected group of the documents in which the documents are in mutually overlapping positions with a mutual pitch in transport direction is present in the delivery portion of the transport path, wherein the collected and mutually overlapping documents in the collecting portion are displaced along the collecting portion of the transport path relative to the previously collected group of documents in the delivery portion of the transport path;

displacing the remaining documents of the previously collected group of documents in the delivery portion of the transport path relative to the collected and mutually overlapping documents in the collecting portion;

in response to the delivery of a last document of the previously collected group from said delivery portion, transporting all documents collected in said collecting portion to said delivery portion; and in response to the document feeding device feeding additional documents after the passing-on of said group of documents from the collecting portion to the delivery portion and prior to the piece-by-piece delivery of a last document of said group from the delivery portion, during the piece-by-piece delivery of documents of said group from the delivery portion, collecting the additional documents fed by the feeding device in the collecting portion.

* * * * *